US006405512B1

(12) United States Patent
Tornberg

(10) Patent No.: US 6,405,512 B1
(45) Date of Patent: Jun. 18, 2002

(54) APPARATUS AND PROCESS FOR MANUFACTURING METAL POWDER IN CAPSULES

(75) Inventor: Claes Tornberg, Kapfenberg (AT)

(73) Assignee: Böhler Edelstahl GmbH & Co. KG, Kapfenberg (AT)

( * ) Notice: Subject to any disclaimer, the term of this patent is extended or adjusted under 35 U.S.C. 154(b) by 0 days.

(21) Appl. No.: 09/456,436

(22) Filed: Dec. 8, 1999

(30) Foreign Application Priority Data

Dec. 9, 1998 (AT) ..... 2066/98

(51) Int. Cl.[7] ..... B65B 63/00

(52) U.S. Cl. ..... 53/428; 53/467; 53/122; 53/235

(58) Field of Search ..... 53/467, 122, 235; 75/338

(56) References Cited

U.S. PATENT DOCUMENTS

| | | | | |
|---|---|---|---|---|
| 3,695,795 A | * 10/1972 | Jossick | ..... | 75/338 |
| 4,124,377 A | * 11/1978 | Larson | ..... | 75/338 |
| 4,810,284 A | * 3/1989 | Auran | ..... | 75/338 |
| 5,272,718 A | * 12/1993 | Stenzel | ..... | 75/338 |
| 5,433,978 A | * 7/1995 | Shield | ..... | 75/338 |

FOREIGN PATENT DOCUMENTS

| | | |
|---|---|---|
| DE | 3019047 | 12/1980 |
| DE | 3546040 | 7/1987 |
| DE | 3913649 | 1/1991 |
| SE | 421758 | 2/1982 |
| WO | 89/05197 | 6/1989 |

* cited by examiner

*Primary Examiner*—John Sipos
(74) *Attorney, Agent, or Firm*—Greenblum & Bernstein, P.L.C.

(57) ABSTRACT

Apparatus and process for manufacturing metal powder from a molten mass. The process occurs in an apparatus that includes at least one metallurgical vessel adapted to at least one of treat and prepare a batch of the molten mass, and an atomizing chamber including a nozzle part adapted to sputter a portion of the molten mass, a feed side coupled to the metallurgical vessel, and a discharge side. The atomizing chamber has a longitudinal axis arranged inclined downwardly from the feed side to the discharge side. The apparatus also includes a separator adapted for classifying the metal powder, and an encapsulating facility including at least one container. The metal powder is to be inserted and enclosed within the at least one container. A conveyance unit for powder transport includes an ascending pipe oriented to guide the metal powder upwardly. A diverting part is coupled to the discharge side and to a first end of the ascending pipe, and a disintegrator is coupled between a second end of the ascending pipe and the separator. A deflection valve is coupled the disintegrator to the separator. A collecting basin is coupled between the separator and the encapsulating facility, and a shut-off device couples the collecting basin to the encapsulating facility.

26 Claims, 1 Drawing Sheet

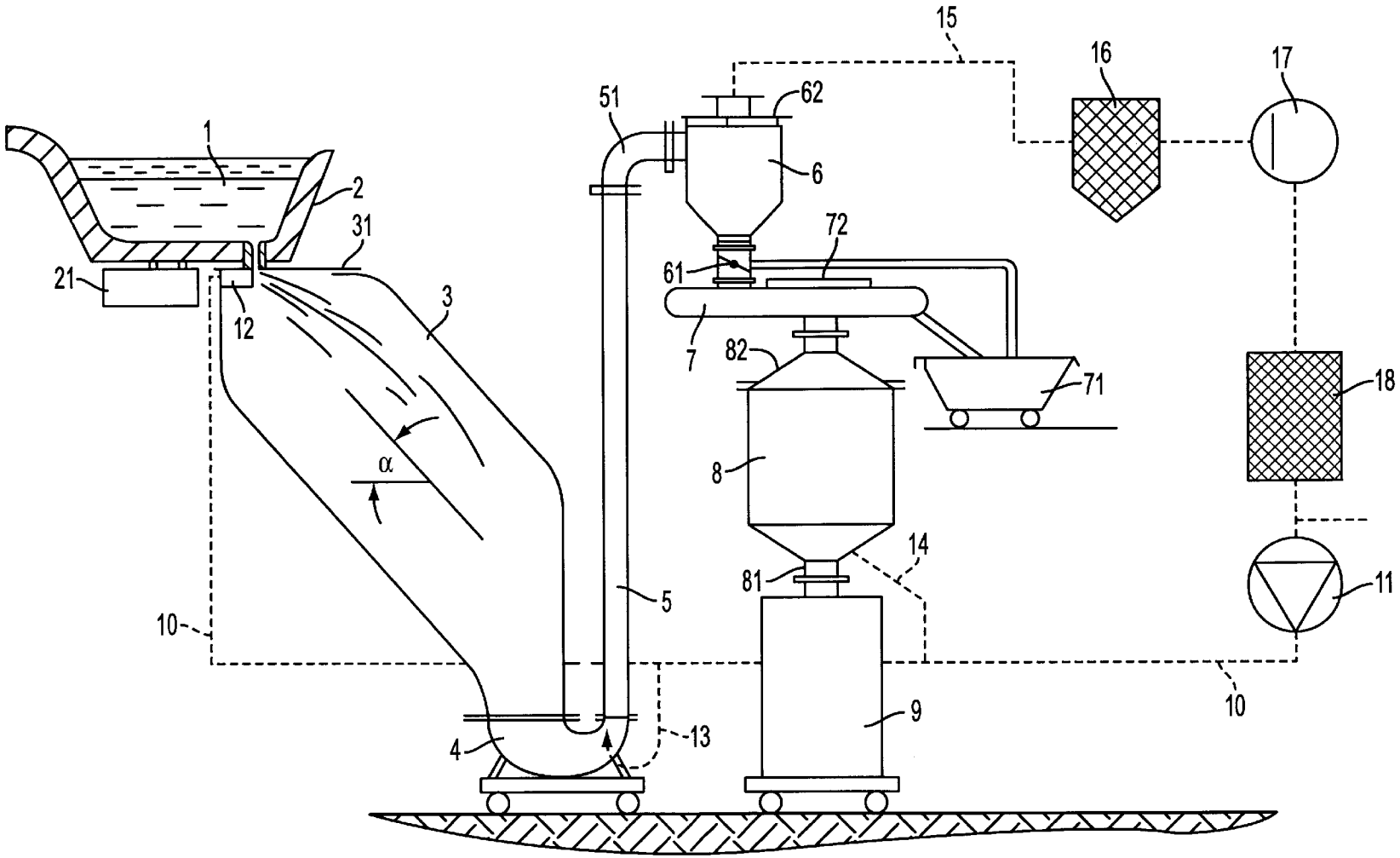
FIGURE

APPARATUS AND PROCESS FOR MANUFACTURING METAL POWDER IN CAPSULES

CROSS-REFERENCE TO RELATED APPLICATIONS

The present application claims priority under 35 U.S.C. §119 of Austrian Patent Application No. 2066/98, filed on Dec. 9, 1998, the disclosure of which is expressly incorporated by reference herein in its entirety.

BACKGROUND OF THE INVENTION

1. Field of the Invention

The present invention relates to an apparatus and to a process to create input material for parts to be manufactured using powder metallurgy. More particularly, the instant invention relates to a device for manufacturing metal powder from a molten mass that includes at least one metallurgical vessel for treating and/or preparing the liquid metal, an atomizing chamber having a nozzle part for sputtering the liquid metal, and a separator for classifying the metal powder formed. The device also includes an encapsulating facility for introducing and enclosing the formed metal powder in a container, a conveyance and connecting unit for powder transport-in the device, and lines with regulators and connections for preparing the atomizing media.

Moreover, the invention relates to a process for manufacturing metal powder from molten mass which includes liquid metal being introduced from a metallurgical vessel into an atomizing chamber, sputtering the liquid metal via a gaseous medium, and allowing it to solidify. The metal powder formed in this way is classified and filled into capsules, which are closed or supplied for further processing.

2. Discussion of Background Information

Work pieces and parts that are produced using powder metallurgy have a consistently fine-grained isotropic structure and, therefore, also advantageously similar material properties independent of the direction of stress. The favorable structural characteristics and, e.g., mechanical property characteristics are compared with conventional goods, which are essentially improved with high-alloy PM materials, because they do not have rough primary precipitations even if the respective content of the elements causing these precipitations is high. Powder metallurgical manufacturing of work pieces takes place essentially by way of a metal molten mass being introduced in a thin stream into a cavity, a so-called "atomizing chamber," and the molten mass stream is split into small droplets by a gas stream coming from nozzles having or causing a high kinetic energy. In further passing through the chamber, the droplets solidify in an extremely short time and are collected as powder particles. Finally, additional cooling takes place and, if necessary, classification of the metal powder, which can be enclosed in a metal capsule, can occur by subjecting the capsules to a pressing cycle at high temperature. This hot pressing can be executed by forging or rolling the capsules brought to the deformation temperature, by high-temperature isostatic pressing (HIP-process), or by baking the powder particles and by eliminating the cavities between these particles. In this manner, a completely dense work piece with an extremely fine-grained all-round homogeneous structure can be created.

A device for manufacturing metal powder can have an essentially vertical or an essentially horizontal atomizing chamber depending upon the atomizing type or direction that is planned for the metal molten mass.

If the gas stream sputtering the liquid metal in the direction of the molten mass stream is guided downward, as in a device disclosed, e.g., in SE-AS-421758, an atomizing chamber with its longitudinal axis aligned vertically can be used advantageously. However, such types of atomizing devices as a whole have a considerable height, which is something that can have negative effects on facilities and hall costs.

An atomizing chamber that has a length that is essentially horizontally aligned preferably finds application with a sputtering process in which the gas stream laterally impacts the metal stream introduced into the chamber at an angle of approximately 90°, as disclosed in, e.g., International Publication No. WO 89/05197. While such horizontal chambers are built low in terms of installation, most of the time, they require additional gas inlets and/or other devices to convey or bring about the solidification of the metal droplets and the powder transport, and to diminish its thermal load.

In the case of all devices for manufacturing metal powder from a molten mass, air admission should be avoided to the greatest extent possible during the entire preparation process leading up to powder encapsulation. This requirement necessitates great facility-related and procedural expenditures such that only absolutely necessary vessel openings with especially effective seals are provided for in the device, which often impedes some service work.

After processing a molten mass into powder, residues can remain in the device which are output with the subsequent batch and are further processed with it. If necessary, this blending of the residual quantities is tolerable, if, in the future, the same kind of molten mass or molten mass of a same quality of steel arrives for processing within the prescribed narrow range of the chemical composition. Otherwise, an expensive and time-consuming cleaning of the atomizing chamber is required and/or the first runnings or the first partial incidence of powder must be scrapped and assigned to the waste pile.

When splitting the molten mass stream in the atomizing chamber, the size of the droplets formed with unchanged gas precipitation depends on the temperature of the molten mass and, in particular, on either the speed or the ferrostatic pressure with which it is guided into the chamber. Therefore, if the temperature of the bath and/or the metal bath height in the metallurgical vessel are not kept largely constant over the atomizing period, different powder particle classifications can be formed according to the dependencies and, in the future, can be stored in layers in the capsule, such that non-homogeneities are created with higher residual cavities at least in its longitudinal direction.

SUMMARY OF THE INVENTION

Based upon the state of the art, the present invention provides a device for manufacturing metal powder from a molten mass favoring preferred solidification criteria of the metal droplets. The device includes a special atomizing chamber, and, using an advantageous simple powder transfer into the device, makes the densest possible powder particle packing available for filling capsules and has a low structural device height as well as high economic efficiency in terms of device preparation.

In addition, the present invention provides a process in which powder can be manufactured from liquid metal in a simple and economical manner, and capsule inserts with a high density and homogeneity can be prepared from this powder.

According to the present invention, the device can include, in addition to certain features of the device generally discussed above, an atomizing chamber connected on a feed side of a metallurgical vessel, which is designed to be inclined downwards at an angle in its longitudinal extension. Further a diverting part cooperates with a discharge side metallurgical vessel, such that a pipe is coupled to the discharge side and pointed upwardly in a continuation of a conveyance path for the powder. The ascending pipe opens into a disintegrator arranged in front of a separator, such that the separator is connected to the disintegrator through a deflection valve. A collecting basin is coupled to the separator, and can be brought into connection with an encapsulating facility or a powder capsule through a shut-off device.

Certain advantages of the present invention are apparent in that the individual parts of the device can be optimized in terms of their respective functions relative to the high requirements on the metal powder or the final powder, and can be coordinated synergistically with one another. Further, the device has high economic efficiency, operating safety, and overall availability. According to arrangement of the device, an inclined position of the atomizing chamber can cause an extension of a flight parabola and, thus, extend a cooling time or solidification time of the metal droplets within the atomizing medium. A small-scale collection of powder particles can be achieved in an advantageous manner through the diverting part with subsequent introduction and conveyance in an ascending pipe to the separator. As a result, accumulations of powder residues in conveyance-related dead-center positions may be avoided, and the height of the device as a whole may be reduced.

The disintegrator positioned after the ascending pipe, e.g., in an upper position, has the advantage that the powder can be easily fed to a separator utilizing gravitational force. In this same manner, selected powder fractions can be subsequently introduced into a collecting basin. According to the invention, the collecting basin can include a shut-off device on a discharge side so that, if necessary, large quantities of powder can be filled into a plurality of small capsules in accordance with production requirements.

In order to further increase the availability or utility of the device and to enable the execution or performance of any required cleaning of the device, e.g., due to a batch change, with high efficiency in short periods of time, certain portions of the atomizing chamber, the ascending pipe, the disintegrator, the separator, and the collecting basin can have at least one short-term detachable and fastenable cleaning closure device, or a similar cleaning opening. Moreover, the diverting part can also be designed to be removable.

Both maintaining cleanliness and corresponding short-term cleaning of the atomizing chamber can be promoted if the angle of inclination alpha ($\alpha$) of the atomizing chamber is between approximately 5° and 60°. In this manner, the solidification of the metal droplets and the further cooling of the powder particles may be favorably influenced.

Further, if the diverting part and/or the ascending pipe includes at least one feed for conveyor gas that is effective within the ascending pipe, particularly favorable flow conditions can be coordinated and advantageous powder conveyance within the device can be achieved by setting respective internal pressure conditions.

The powder, which often develops with different particle sizes over time during the manufacturing process as a function of the batch, can be treated before being introduced into a capsule, e.g., if the collecting basin has at least one connection on a base side for feeding gas for homogenizing the powder fractions.

Particularly advantageous with respect to manufacturing costs, but also concerning the quality assurance and documentation of a product, a volumetric capacity of the collecting basin can correspond to the powder quantity which can be prepared from a batch of liquid metal in the distributor.

In order to achieve particular product quality, it may be preferable for a pressure that lies more than 0.1 bar above the ambient pressure to be adjustable via a transmission system in all parts bombarded with metal powder as well as the gas cleaning components and similar cooling components.

It may also be favorable for the quality of the liquid metal and the atomizing results to feed thermal energy to the molten mass in the distributor and/or this thermal energy can be moved by a magnetic device.

Further, the present invention is directed to a process in which metal powder is formed in the atomizing chamber, which is inclined diagonally downwardly, and the metal powder is brought to a lower or discharge-side area of the chamber to be introduced into a subsequently attached diverting part and conveyed upwardly in a pipe guide by an introduced conveyor gas. The metal powder is introduced into a disintegrator, e.g., a cyclone separator, to be disintegrated. The disintegrated powder is subsequently classified so that desired fractions of the powder are collected in a container that is flowed through from below with gas and mixed to a desired homogenized quantity. The metal powder is then introduced into a capsule and the capsule is closed.

The advantages of the process according to the present invention include that the trajectory of the droplets is enlarged in the inclined atomizing chamber when the liquid metal stream is being sputtered, and solidification and effective cooling of the powder particles are effected early on in the process by the atomizing medium. The transport of the powder takes place with comparatively low gas flow through the chamber so that collection and introduction of the particles in the diverting pipe is given under favorable conditions. The powder can be conveyed upwardly from the diverting part by conveyor gas, which exerts an additional cooling effect. Further, the powder can be subsequently disintegrated, classified, and introduced into the collecting basin under a low thermal load and through the effects of gravitational force. Particularly effective and quality-enhancing for use in capsules is the powder being flowed through from below with gas according to the invention, because, not only is a homogenous powder mixture formed, but dense powder particle packing can also be achieved.

Oxidation of the powder particle surfaces and an internal inert gas load during hot compacting into non-porous work pieces can be prevented if the manufacture of the metal powder and its encapsulation occurs without the admission of air or with an excess pressure of inert gas in the system.

With respect to maximum quality requirements for the product as well as optimal quality assurance and documentation, it may be preferable if, in a first processing step, a batch or molten mass is atomized to metal powder and, after processing, this powder is introduced into at least one capsule and enclosed therein. Subsequently, the opening of the cleaning closures arranged in the individual parts of the device can be performed and the device parts can be cleaned of powder residues. Further, the cleaning openings can be sealed and the device can be made available for atomizing another batch.

The present invention is directed to an apparatus for manufacturing metal powder from a molten mass that includes at least one metallurgical vessel adapted to at least one of treat and prepare a batch of the molten mass, and an atomizing chamber including a nozzle part adapted to sputter a portion of the molten mass, a feed side coupled to the metallurgical vessel, and a discharge side. The atomizing chamber has a longitudinal axis arranged inclined downwardly from the feed side to the discharge side. The apparatus also includes a separator adapted for classifying the metal powder, and an encapsulating facility including at least one container. The metal powder is to be inserted and enclosed within the at least one container. A conveyance unit for powder transport includes an ascending pipe oriented to guide the metal powder upwardly. A diverting part is coupled to the discharge side and to a first end of the ascending pipe, and a disintegrator is coupled between a second end of the ascending pipe and the separator. A deflection valve is coupled the disintegrator to the separator. A collecting basin is coupled between the separator and the encapsulating facility, and a shut-off device couples the collecting basin to the encapsulating facility.

According to a feature of the present invention, supply lines and regulators can be adapted to prepare an atomizing medium.

In accordance with another feature of the invention, the atomizing chamber can be oriented at an angle $\alpha$ to a horizontal reference. The angle $\alpha$ may be between approximately 5° and 60°.

According to still another feature of the invention, the atomizing chamber, the ascending pipe, the disintegrator, the separator, and the collecting basin each include at least one detachably fastenable closure device located to facilitate cleaning. The diverting part can be removably couplable to the discharge side and to the first end.

In accordance with a further feature of the present invention, at least one of the diverting part and the ascending pipe include at least one feed port for supplying a conveyor gas to the ascending pipe.

According to a still further feature of the instant invention, the collecting basin may include a base portion, and at least one connection for supplying feed gas to the collecting basin may be coupled to the base portion. In this manner, the feed gas can homogenize powder fractions within the collecting basin.

Further, the collecting basin can include a volumetric capacity which corresponds to a powder quantity which can be prepared from the batch of the molten mass.

A gas transmission system can be adapted to adjust a gas pressure within elements of the apparatus that receive the metal powder to more than 0.1 bar above an ambient pressure. Further, the transmission system may include gas cleaning components, a gas cooling component, and gas conduits interconnecting the transmission system to the elements that receive the metal powder.

According to another feature of the invention, thermal energy can be at least one of fed to the molten mass in the metallurgical vessel and moved by a magnetic device.

In accordance with a further feature of the present invention, the disintegrator may include a gas evacuation port in which conveyor gas is removed from the disintegrator. Further, a first and second gas cleaning device and a gas cooling device can be provided, such that the conveyor gas can be removed from the disintegrator and be sequentially guided through the first gas cleaning device, the gas cooling device, and the second gas cleaning device. A conveying conduit may be coupled to the second gas cleaning device and to the nozzle part, such that the conveyor gas may be utilized as the atomizing medium.

In accordance with still another feature of the instant invention, a powder scrap container may be coupled to the deflection valve and to the separator.

The present invention is directed to a process for manufacturing metal powder from a molten mass of a liquid metal in an apparatus that includes a metallurgical vessel containing the liquid metal, a diverting part, and an atomizing chamber having a longitudinal axis inclined diagonally downward from a feed side, which is coupled to the metallurgical vessel, to a discharge side, which is coupled to the diverting part. The process includes introducing the liquid metal into the atomizing chamber from the metallurgical vessel, and sputtering the introduced liquid metal in a gaseous medium. In this manner, the sputtered liquid metal is solidified into a metal powder. The process also includes accumulating the metal powder in the discharge side and introducing the accumulated metal powder into the diverting part, supplying a conveyor gas and transporting the metal powder from the diverting part upwardly through a pipe via the conveyor gas, disintegrating the metal powder in a disintegrator, and classifying the metal powder. The process further includes passing desired fractions of the metal powder to a collecting basin, supplying a gas to a bottom of the collecting basin to homogenize the metal powder in the collecting basin, filling at least one container with the metal powder, and closing the at least one container containing the metal powder.

In accordance with a feature of the present invention, the disintegrator can include a cyclone separator.

According to another feature of the process, the metal powder formation and the filling of the containers may occur one of: (A) without the admission of air; and (B) with an excess pressure of inert gas in the system.

In accordance with a further feature of the instant invention, the process can further include processing a liquid metal of a first type into a first type metal powder and filling the container with the first type metal powder, cleaning the apparatus of first type powder residues, and processing a liquid metal of a second type into a second type metal powder and filling the container with the second type metal powder. Further, wherein the cleaning of the apparatus may include opening detachably fastenable openings in the atomizing chamber, the disintegrator, the separator, and the collecting basin, and removing the diverting part.

According to still another feature of the invention, the disintegrator may include a gas evacuation port, and the process can further include removing conveyor gas from the disintegrator. Further, the apparatus further includes a first and second gas cleaning device and a gas cooling device, and the process can further include sequentially guiding the removed conveyor gas through the first gas cleaning device, the gas cooling device, and the second gas cleaning device. The process can also include conveying the conveyor gas from the second gas cleaning device and to a nozzle part located at the feed side of the atomizing chamber, and using the conveyor gas as the gaseous medium for sputtering.

The invention is also directed to an apparatus for manufacturing metal powder from a molten mass including at least one metallurgical vessel adapted to at least one of treat and prepare a batch of the molten mass, and an atomizing chamber including a nozzle part adapted to sputter a portion of the molten mass, a feed side coupled to the metallurgical vessel, and a discharge side. The atomizing chamber has a longitudinal axis arranged inclined downwardly from the feed side to the discharge side at an angle of between approximately 5° and 60° to a horizontal reference. A separator is adapted for classifying the metal powder, and an encapsulating facility includes at least one container, such that the metal powder is inserted and enclosed within the at least one container. The apparatus includes a conveyance unit, for powder transport through the apparatus, that includes an ascending pipe oriented to guide the metal powder upwardly, supply lines and regulators adapted to prepare an atomizing medium, and a diverting part coupled to the discharge side and to a first end of the ascending pipe. A disintegrator is coupled between a second end of the ascending pipe and the separator, such that a deflection valve is coupled the disintegrator to the separator, and a collecting basin coupled between the separator and the encapsulating facility, such that a shut-off device couples the collecting basin to the encapsulating facility. The atomizing chamber, the ascending pipe, the disintegrator, the separator, and the collecting basin each include at least one detachably fastenable closure device located to facilitate cleaning, and the diverting part is removably couplable to the discharge side and to the first end.

According to another feature of the present invention, at least one of the diverting part and the ascending pipe can include at least one feed port for supplying a conveyor gas to the ascending pipe.

In accordance with yet another feature of the instant invention, the collecting basin may include a base portion, and at least one connection for supplying feed gas to the collecting basin may be coupled to the base portion, so that the feed gas homogenizes powder fractions within the collecting basin.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of a non-limiting example of exemplary embodiment of the present invention, and wherein:

The Figure illustrates an exemplary arrangement for filling capsules with metal powder formed from a molten mass.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As shown schematically in the drawing, a metal molten mass is prepared in a metallurgical vessel 2 and introduced into an atomizing chamber 3 through a nozzle in the form of a thin metal stream. The molten mass can be any metal or metallic alloy desired to form a metal powder. A molten mass movement device 21, e.g., a magnetic coil, can be coupled to a portion, e.g., an underside of, metallurgical vessel 2 to create a melting movement via magnetic fields of traveling wave (e.g., agitating coils in a continuous casting). The metal stream from metallurgical vessel 2 into atomizing chamber 3 is sputtered by a gas stream (atomizing gas), e.g., any inert gas, such as argon and preferably nitrogen, with high kinetic energy output from a gas nozzle part 12, which is located in an upper section of atomizing chamber 3. Powder particles that are thereby formed are introduced or fall into a diverting part 4 coupled to a bottom or discharge end of metallurgical vessel 3. Moreover, a longitudinal axis of atomizing chamber 3 can be oriented at an angle $\alpha$ between approximately 5° and 60° to the horizontal. Further, atomizing chamber 3 can be oriented such that the angle of decline is in a direction of flight of the sputtered metal stream, i.e., formed metal powder.

The powder collected at diverting part 4 is conveyed, via a conveyor gas, upwardly through an ascending pipe 5. The conveyor gas is supplied to ascending pipe 5 via of conveyor gas line 13 of a compressed gas transmission system 10. Ascending pipe 5 is attached to a disintegrator 6 through a feed pipe 51. The atomizing gas and the conveyor gas are fed back or removed from disintegrator 6 via a gas return line 15, which can be coupled to a top of disintegrator 6, e.g., to a disintegrator cover 62. The atomizing gas and the conveyor gas are returned to nozzle 12 and gas line 13, respectively, through a series connection of a filter 16, a gas cooler 17, and a fine filter 18 of a pump 11. The metal powder can pass from disintegrator 6 through a series connected deflection valve 61, which is utilized be used to feed a scrap portion to a powder scrap container 71, and to direct the remaining portion of the metal powder into a separator 7. Desired powder fractions can be prepared by separator 7, which includes, e.g., a sieve or screen to separate fine (i.e., desired) powder from coarse powder, and can be subsequently introduced into a collecting basin 8. The coarse powder can be rejected and supplied to powder scrap container 71. The powder fraction introduced to collecting basin 8 can be at least intermittently homogenized or mixed by a gas 14 supplied to collecting basin 8 through a base of thereof. In particular, a shut-off device 81 is located in a base region of collecting basin 8. Thus, when shut-off device 81 is closed, the metal powder within collecting basin 8 can be blended (permanently or before being dispensed into powder capsule(s) 9) with mixing gas 14. The prepared metal powder formed from metal molten mass 1 (or another batch) can be introduced into one or more powder capsule(s) 9 from collecting basin 8 through a shut-off device 81.

Compressed gas transmission system 10 can include an inner overpressure of, e.g., approximately 0.1 bar over the surrounding (ambient) pressure, and this overpressure can be produced in compressed gas transmission system 10, including gas line 13, gas return line 15, pump 11, gas purifiers 16 and 18, and gas cooler 17, and in atomizing chamber 3, ascending pipe 5, disintegrator 6, separator 7, collecting basin 8, and powder capsule(s) 9.

As noted above, powder scrap container 71 can be loaded via deflection valve 61 or with the coarse components (i.e., grains with large diameters) from separator 7. In this regard, if the process of the instant invention is proceeding normally, the occurrence of coarse components out of separator 7 is small, e.g., between approximately 2% and 7%. This scrap powder can be utilized, e.g., to produce a new molten mass.

Closable cleaning openings can be provided in order to facilitate cleaning the various elements of the device. For example, it is desirable to clean the device when a metal molten mass 1 is to be processed which differs in composition from the previously processed metal molten mass. Atomizing chamber 3 includes a removable covering 31 positioned over an upper cleaning opening, and the discharge side of atomizing chamber 3 can be opened or accessed by removing diverting part 4. Ascending pipe 5 and disintegrator 6 can be cleaned of powder residues when feed pipe 51 is detached and disintegrator covering 62 is removed. Likewise, detachable covers are provided to facilitate access to the interiors of separator 7 and collecting basin 8.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 metal molten mass
2 metallurgical vessel
21 molten mass movement device
3 atomizing chamber
31 cover for the upper cleaning opening
4 diverting part
5 ascending pipe
51 feed pipe to disintegrator
6 disintegrator
61 deflection valve
62 disintegrator cover
7 separator
71 powder scrap container
72 separator cleaning cover
8 collecting basin
81 shut-off device
82 container cover
9 powder capsule
10 compressed gas transmission system
11 pump
12 gas nozzle part
13 conveyor gas feed
14 mixed gas feed
15 gas return line
16 filter
17 gas cooler
18 fine filter

What is claimed:

1. An apparatus for manufacturing metal powder from a molten mass comprising:

at least one metallurgical vessel adapted to at least one of treat and prepare a batch of the molten mass;

an atomizing chamber including a nozzle part adapted to sputter a portion of the molten mass, a feed side coupled to said metallurgical vessel, and a discharge side, wherein said atomizing chamber has a longitudinal axis arranged inclined downwardly from said feed side to said discharge side;

a separator adapted for classifying the metal powder;

an encapsulating facility including at least one container, wherein the metal powder is inserted and enclosed within said at least one container;

a conveyance unit for powder transport comprising an ascending pipe oriented to guide the metal powder upwardly;

a diverting part being coupled to said discharge side and to a first end of said ascending pipe;

a disintegrator being coupled between a second end of said ascending pipe and said separator, wherein a deflection valve coupled said disintegrator to said separator; and a collecting basin coupled between said separator and said encapsulating facility, wherein a shut-off device couples said collecting basin to said encapsulating facility.

2. The apparatus in accordance with claim 1, further comprising supply lines and regulators adapted to prepare an atomizing medium.

3. The apparatus in accordance with claim 1, wherein said atomizing chamber is oriented at an angle $\alpha$ to a horizontal reference.

4. The apparatus in accordance with claim 3, wherein said angle $\alpha$ is between approximately 5° and 60°.

5. The apparatus in accordance with claim 1, wherein said atomizing chamber, said ascending pipe, said disintegrator, said separator, and said collecting basin each comprise at least one detachably fastenable closure device located to facilitate cleaning, and wherein said diverting part is removably couplable to said discharge side and to said first end.

6. The apparatus in accordance with claim 1, wherein at least one of said diverting part and said ascending pipe include at least one feed port for supplying a conveyor gas to said ascending pipe.

7. The apparatus in accordance with claim 1, wherein said collecting basin includes a base portion, and at least one connection for supplying feed gas to said collecting basin is coupled to said base portion, whereby said feed gas homogenizes powder fractions within said collecting basin.

8. The apparatus in accordance with claim 1, wherein said collecting basin comprises a volumetric capacity which corresponds to a powder quantity which can be prepared from the batch of the molten mass.

9. The apparatus in accordance with claim 1, further comprising a gas transmission system adapted to adjust a gas pressure within elements of said apparatus that receive the metal powder to more than 0.1 bar above an ambient pressure.

10. The apparatus in accordance with claim 9, said transmission system comprising gas cleaning components, a gas cooling component, and gas conduits interconnecting the transmission system to said elements that receive the metal powder.

11. The apparatus in accordance with claim 1, wherein thermal energy is at least one of fed to the molten mass in said metallurgical vessel and moved by a magnetic device.

12. The apparatus in accordance with claim 1, wherein said disintegrator includes a gas evacuation port in which conveyor gas is removed from said disintegrator.

13. The apparatus in accordance with claim 12, further comprising a first and second gas cleaning device and a gas cooling device, wherein the conveyor gas removed from said disintegrator is sequentially guided through said first gas cleaning device, said gas cooling device, and said second gas cleaning device.

14. The apparatus in accordance with claim 13, further comprising a conveying conduit coupled to said second gas cleaning device and to said nozzle part, wherein said conveyor gas is utilized as the atomizing medium.

15. The apparatus in accordance with claim 1, further comprising a powder scrap container coupled to said deflection valve and to said separator.

16. A process for manufacturing metal powder from a molten mass of a liquid metal in an apparatus that includes a metallurgical vessel containing the liquid metal, a diverting part, and an atomizing chamber having a longitudinal axis inclined diagonally downward from a feed side, which is coupled to the metallurgical vessel, to a discharge side, which is coupled to the diverting part, the process comprising:

introducing the liquid metal into the atomizing chamber from the metallurgical vessel;

sputtering the introduced liquid metal in a gaseous medium, whereby said sputtered liquid metal is solidified into a metal powder;

accumulating the metal powder in the discharge side and introducing the accumulated metal powder into the diverting part;

supplying a conveyor gas and transporting the metal powder from the diverting part upwardly through a pipe via the conveyor gas;

disintegrating the metal powder in a disintegrator;

classifying the metal powder;

passing desired fractions of the metal powder to a collecting basin;

supplying a gas to a bottom of the collecting basin to homogenize the metal powder in the collecting basin;

filling at least one container with the metal powder; and closing the at least one container containing the metal powder.

17. The process in accordance with claim 16, wherein the disintegrator comprises a cyclone separator.

18. The process in accordance with claim 16, wherein the metal powder formation and the filling of the containers occurs one of:

(A) without the admission of air; and (B) with an excess pressure of inert gas in the system.

19. The process in accordance with claim 16, further comprising:

processing a liquid metal of a first type into a first type metal;

cleaning the apparatus of first type powder residues; and processing a liquid metal of a second type into a second type metal.

20. The process in accordance with claim 19, wherein the cleaning of the apparatus includes opening detachably fastenable openings in the atomizing chamber, the disintegrator, the separator, and the collecting basin; and removing the diverting part.

21. The process in accordance with claim 16, wherein the disintegrator includes a gas evacuation port, and the process further comprises:

removing conveyor gas from the disintegrator.

22. The process in accordance with claim 21, the apparatus further including a first and second gas cleaning device and a gas cooling device, and the process further comprises:

sequentially guiding the removed conveyor gas through the first gas cleaning device, the gas cooling device, and the second gas cleaning device.

23. The process in accordance with claim 22, further comprising conveying the conveyor gas from the second gas cleaning device and to a nozzle part located at the feed side of the atomizing chamber; and using the conveyor gas as the gaseous medium for sputtering.

24. An apparatus for manufacturing metal powder from a molten mass comprising:

at least one metallurgical vessel adapted to at least one of treat and prepare a batch of the molten mass;

an atomizing chamber including a nozzle part adapted to sputter a portion of the molten mass, a feed side coupled to said metallurgical vessel, and a discharge side, wherein said atomizing chamber has a longitudinal axis arranged inclined downwardly from said feed side to said discharge side at an angle of between approximately 5° and 60° to a horizontal reference;

a separator adapted for classifying the metal powder;

an encapsulating facility including at least one container, wherein the metal powder is inserted and enclosed within said at least one container;

a conveyance unit for powder transport through said apparatus, said conveyance unit comprising an ascending pipe oriented to guide the metal powder upwardly;

supply lines and regulators adapted to prepare an atomizing medium;

a diverting part being coupled to said discharge side and to a first end of said ascending pipe;

a disintegrator being coupled between a second end of said ascending pipe and said separator, wherein a deflection valve coupled said disintegrator to said separator; and a collecting basin coupled between said separator and said encapsulating facility, wherein a shut-off device couples said collecting basin to said encapsulating facility, wherein said atomizing chamber, said ascending pipe, said disintegrator, said separator, and said collecting basin each comprise at least one detachably fastenable closure device located to facilitate cleaning, and wherein said diverting part is removably couplable to said discharge side and to said first end.

25. The apparatus in accordance with claim 24, wherein at least one of said diverting part and said ascending pipe include at least one feed port for supplying a conveyor gas to said ascending pipe.

26. The apparatus in accordance with claim 24, wherein said collecting basin includes a base portion, and at least one connection for supplying feed gas to said collecting basin is coupled to said base portion, whereby said feed gas homogenizes powder fractions within said collecting basin.

* * * * *